US010201991B2

(12) United States Patent
Sugaya et al.

(10) Patent No.: US 10,201,991 B2
(45) Date of Patent: Feb. 12, 2019

(54) INKJET PRINTING APPARATUS AND METHOD FOR CONTROLLING INKJET PRINTING APPARATUS

(71) Applicant: Konica Minolta, Inc., Tokyo (JP)

(72) Inventors: Toyoaki Sugaya, Hachioji (JP); Takashi Muramatsu, Hachioji (JP)

(73) Assignee: KONICA MINOLTA, INC., Tokyo (JP)

( * ) Notice: Subject to any disclaimer, the term of this patent is extended or adjusted under 35 U.S.C. 154(b) by 0 days.

(21) Appl. No.: 15/568,214

(22) PCT Filed: Apr. 12, 2016

(86) PCT No.: PCT/JP2016/061755
§ 371 (c)(1),
(2) Date: Oct. 20, 2017

(87) PCT Pub. No.: WO2016/171032
PCT Pub. Date: Oct. 27, 2016

(65) Prior Publication Data

US 2018/0111395 A1 Apr. 26, 2018

(30) Foreign Application Priority Data

Apr. 21, 2015 (JP) ..... 2015-086959

(51) Int. Cl.
*B41J 25/308* (2006.01)
*B41J 13/00* (2006.01)
(Continued)

(52) U.S. Cl.
CPC ..... *B41J 13/0009* (2013.01); *B41J 11/006* (2013.01); *B41J 11/0095* (2013.01);
(Continued)

(58) Field of Classification Search
USPC ..... 347/8, 9, 16, 17, 101
See application file for complete search history.

(56) References Cited

U.S. PATENT DOCUMENTS 7,044,575 B2 * 5/2006 Kelley ..... B41J 25/308 347/16
8,727,469 B2 * 5/2014 Hattori ..... B41J 25/308 347/17
8,740,326 B2 * 6/2014 Korogi ..... B41J 11/002 347/101

FOREIGN PATENT DOCUMENTS

JP 9-39221 A 2/1997
JP 2007-144633 A 6/2007
(Continued)

OTHER PUBLICATIONS

International Preliminary Report on Patentability, PCT/JP2016/061755, dated Oct. 24, 2017.
(Continued)

*Primary Examiner* — Lam S Nguyen
(74) *Attorney, Agent, or Firm* — Lucas & Mercanti, LLP

(57) ABSTRACT

An inkjet printing apparatus includes a conveyer conveying a printing medium; an image former discharging ink on the printing medium; a mover relatively moving the image former and the conveyer; a first detector; a second detector; and a controller controlling image formation. The mover performs a first move operation to expand a distance between the image former and the printing medium and a second move operation to expose the conveying surface. Upon detection of an abnormal conveyance state of the printing medium by the first detector, the conveyer stops conveyance and the mover performs the first move operation. After stopping the conveyance and the first move operation, the controller checks for the contact of the printing medium and the image former during the second move
(Continued)

operation based on the detection results at the second detector, and only if no contact is determined, the mover performs the second move operation.

18 Claims, 8 Drawing Sheets

(51) Int. Cl.
*B65H 7/14* (2006.01)
*B41J 29/393* (2006.01)
*B41J 11/00* (2006.01)

(52) U.S. Cl.
CPC ..... *B41J 25/308* (2013.01); *B41J 29/393* (2013.01); *B65H 7/14* (2013.01)

(56) References Cited

FOREIGN PATENT DOCUMENTS

| | | | |
|---|---|---|---|
| JP | 2010111474 | A | 5/2010 |
| JP | 2010-149307 | A | 7/2010 |
| JP | 2010-173812 | A | 8/2010 |
| JP | 2012-51282 | A | 3/2012 |
| JP | 2012106495 | A | 6/2012 |
| JP | 2012143944 | A | 8/2012 |
| JP | 2013-71437 | A | 4/2013 |

OTHER PUBLICATIONS

International Search Report dated Jul. 5, 2016 for PCT/JP2016/061755 and English translation.

* cited by examiner

INKJET PRINTING APPARATUS AND METHOD FOR CONTROLLING INKJET PRINTING APPARATUS

CROSS REFERENCE TO RELATED APPLICATION

This Application is a 371 of PCT/JP2016/061755 filed on Apr. 12, 2016, which, in turn, claimed the priority of Japanese Patent Application No. JP 2015-086959 filed on Apr. 21, 2015, both applications are incorporated herein by reference.

TECHNOLOGICAL FIELD

The present invention relates to inkjet printing apparatus and methods for controlling them.

BACKGROUND ART

Typical inkjet printing apparatus discharge ink from nozzles provided in printing heads to print an image on a printing medium. In each inkjet printing apparatus, printing heads provided with nozzle openings have nozzle surfaces facing the printing medium and discharge ink at an appropriate timing while the printing heads is moving relative to the printing medium.

A printing medium improperly disposed on a conveying surface, in particular, a printing medium leaving the conveying surface results in the contact of the printing medium with various portions of the inkjet printing apparatus to damage a nozzle surface or being trapped in a printing head or a head unit provided with the printing head(s) (collectively referred to as an "image former") or in a frame, causing a jam. To cope with this problem, techniques are used to stop printing an image upon occurrence of such a problem or upon detection of a possibility thereof and move the image former to remove the problematic printing medium. PTL 1 discloses techniques to stop conveyance of the printing medium upon detection of a lifting printing medium and then move the image former to a retraction position. PTL 2 discloses techniques to ascend or separate the image former disposed in the vicinity of the conveying surface upon detection of a lifting printing medium in accordance with the uplift level or stop conveying the printing medium.

PTL 3 discloses techniques to prevent attachment of contaminant to a printing medium supporting surface (platen) by preventing exposure thereof when the supporting surface is separated from an image former to remove a jammed printing medium.

RELATED ART DOCUMENTS

Patent Documents

PTL 1: Japanese Unexamined Patent Application Publication No. 2010-111474

PTL 2: Japanese Unexamined Patent Application Publication No. 2012-143944

PTL 3: Japanese Unexamined Patent Application Publication No. 2012-106495

SUMMARY

Unfortunately, despite a limited time to retract the image former after detection of a printing medium in an abnormal conveyance state during image formation, the image former should be retracted sufficiently to allow a user to handle the printing medium properly. Accordingly, an attempt to retract the image former sufficiently without any reference to the situation reduces the retraction efficiency and may even worsen the situation, depending on the state of the printing medium.

An object of the present invention is to provide an inkjet printing apparatus capable of retracting the image former efficiently, depending on the state of a printing medium in an erroneous conveyance, and methods for controlling such an inkjet printing apparatus.

One embodiment of the invention is an inkjet printing apparatus including:

a conveyer conveying a printing medium;

at least one image former discharging ink to form an image on the printing medium;

a mover relatively moving the image former and the conveyer;

a first detector detecting an erroneous conveyance of a printing medium;

a second detector detecting a contact between the printing medium and the image former; and a controller controlling image formation, wherein the mover performs a first move operation relatively moving the image former and the printing medium to expand a distance between the image former and a conveying surface of the printing medium and performs a second move operation relatively moving the image former and the printing medium to expose the conveying surface, upon detection of an abnormal conveyance state of the printing medium by the first detector, the controller instructs the conveyer to stop conveyance and the mover to perform the first move operation, after the conveyer stops conveyance of the printing medium and the first move operation is completed, the controller checks for contact of the image former with the printing medium from start to end of the second move operation based on results of the detection at the second detector before the second move operation is performed, and if no contact is determined, the controller instructs the mover to perform the second move operation; otherwise, the controller does not instruct the mover to perform the second move operation.

Another embodiment of the invention is a method for controlling an inkjet printing apparatus, including a conveyer conveying a printing medium; an image former discharging ink to form an image on the printing medium; a mover moving the image former; a first detector detecting a printing medium in an erroneous conveyance; and a second detector detecting a contact between the printing medium and the image former, the method including:

detecting an abnormal conveyance state of the printing medium by the first detector followed by stopping conveyance by the conveyer and by performing a first move operation to expand the distance between the image former and a conveying surface of the printing medium, determining whether the image former is not in contact with the printing medium from start to end of a second move operation based on results of detection at the second detector, after the conveyer stops conveyance of the printing medium and the first move operation is completed and before the second move operation is performed to expose the conveying surface, and conveyance controlling to allow the mover to perform the second move operation if no contact is determined; or not to allow the mover to perform the second move operation if any contact is determined.

BRIEF DESCRIPTION OF THE DRAWINGS

The advantages and features provided by one or more embodiments of the invention will become more fully understood from the detailed description given hereinbelow and the appended drawings which are given by way of illustration only, and thus are not intended as a definition of the limits of the present invention.

EMBODIMENTS FOR CARRYING OUT THE INVENTION

Hereinafter, one or more embodiments of the present invention will be described with reference to the drawings. However, the scope of the invention is not limited to the disclosed embodiments.

The above-described embodiments of the invention can have an advantageous effect of retracting the image former efficiently and properly, depending on the state of a printing medium in an erroneous conveyance.

Figure 1:
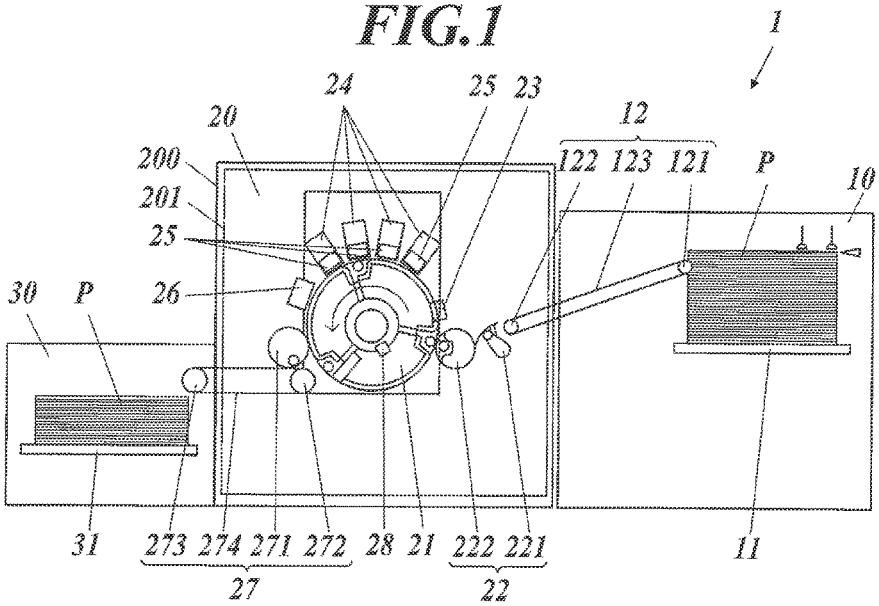
FIG. 1 is a schematic view of an inkjet printing apparatus according to an embodiment of the present invention.

The embodiments of the present invention will now be described with reference to the drawings:

FIG. 1 is a schematic front view of an inkjet printing apparatus 1 according to an embodiment of the present invention to illustrate an entire configuration.

The inkjet printing apparatus 1 according to the embodiment is for business use and can form a large image on a large printing medium of a poster size or a larger size more rapidly than those for domestic use. The inkjet printing apparatus 1 includes a sheet feeder 10 (printing medium feeder), an image former 20, a copy receiving tray 30, and a controller 40 (see FIG. 3). The inkjet printing apparatus 1 conveys a printing medium P from the sheet feeder 10 to the image former 20, forms an image, and then conveys the printing medium P to the copy receiving tray 30 under the control of the controller 40.

The sheet feeder 10 conveys the printing media P stored inside to the image former 20 one by one.

The printing media P may be any one that can be carried on the outer periphery of the image forming drum 21 in a curved state, such as printing paper, transparent sheets, films, and cloths with a variety of thicknesses.

The sheet feeder 10 include a sheet feeding tray 11 storing the printing media P and a feeding board 12 conveying a printing medium P from the sheet feeding tray 11 to the image former 20. The sheet feeding tray 11 is a plate member capable of holding one or more printing media P thereon. The sheet feeding tray 11 is designed to move vertically, depending on the number of the printing media P placed thereon and be maintained at a vertical position at which the top printing medium P can be conveyed smoothly on the feeding board 12.

The feeding board 12 includes a conveyance mechanism which drives a circular belt 123 inside of which is supported by multiple (for example, two) rollers 121 and 122 to convey the printing medium P on the belt 123 and a feeding mechanism which conveys the top printing medium P on the sheet feeding tray 11 onto the belt 123. The feeding board 12 conveys the printing medium P received onto the belt 123 from the feeding mechanism along the belt 123.

The image former 20 includes an image forming drum 21, a reception unit 22, a first sensor 23 (first detector), head units 24 (image formers), second sensors 25 (second detectors), an irradiator 26 (fixer), a delivery unit 27, and a rotation gauge 28.

The image forming drum 21 has a cylindrical outer periphery, carries a printing medium P on the outer periphery, and conveys the printing medium P in accordance with rotation about the central axis of the cylindrical drum. The outer periphery of the image forming drum 21 is heated with a heater 215 to keep the carried printing medium P at an appropriate temperature. Ink is discharged on the printing medium P carried on the image forming drum 21 from nozzles in the head units 24 at positions facing the head units 24 (image forming positions) and attached thereto to form an image.

The reception unit 22 receives a printing medium P from the sheet feeder 10 and then conveys it to the image forming drum 21. The reception unit 22 includes a swing arm 221 which holds one end of the printing medium P conveyed on the feeding board 12 and a cylindrical reception drum 222 which conveys the printing medium P carried on the swing arm 221 to the image forming drum 21. The swing arm 221 receives the printing medium P on the feeding board 12 and then conveys it to the reception drum 222. This allows the reception unit 22 to guide the printing medium P along the outer periphery of the image forming drum 21 and then convey it to the image forming drum 21.

The first sensor 23 is disposed immediately after the position at which the printing medium P is received from the reception unit 22. The first sensor 23 detects uplift of the printing medium P (abnormal conveyance state) placed on the image forming drum 21 upstream of the positions at which the head units 24 form an image on the printing medium P in the conveyance direction. The first sensor 23 is a photosensor which emits directional light and detects the amount of emitted light received by the sensor. More specifically, the first sensor 23 emits light, for example, on the conveying surface of the printing medium P, more accurately, above the outer periphery of the image forming drum 21 by a predetermined distance, i.e., at a predetermined reference level, across the width perpendicular to the conveyance direction along the conveying surface. The directional light includes laser light or light collected as appropriate from LEDs or organic electroluminescent diodes. The emitted light would be normally detected in full by the photodetector 232. If the printing medium P has a portion lifting to the reference level or higher, the lifting portion shields the emitted light and thus reduces the amount of light detected by the sensor. An uplift level resulting in a reduction in amount of light detected by the first sensor 23, that is, a reference level, is a predetermined distance (height) that must be kept between the head units 24 and the printing medium P to prevent a contact therebetween during image formation.

The head units 24 discharges ink drops on the printing medium P, which moves in accordance with the rotation of the image forming drum 21, through nozzle openings at an appropriate timing to form an image. The nozzle openings are provided on the surfaces, facing the printing medium P of the head units 24, of the nozzles. Each head unit 24 includes one or more printing heads each provided with multiple nozzles. The inkjet printing apparatus 1 according to the embodiment is provided with four head units 24 corresponding to four ink colors (a plurality of kinds of ink). The head units are disposed at predetermined intervals along the conveyance direction of the printing medium P. The four head units 24 discharge C (Cyan), M (Magenta), Y (Yellow), and K (Black) inks, respectively. The head units 24 or ink colors however should not be limited to four in number. These inks are cured when exposed to ultraviolet rays. These inks may be heated to and kept at an appropriate temperature inside the head units 24 by a heater other than the heater 215, which heats the image forming drum 21.

Each head unit 24 includes multiple nozzle openings disposed along the width of the printing medium P and a line head. The line head discharges inks on the printing medium P through the nozzle openings while moving the printing medium P in the conveyance direction and forms an image in response to a single pulse. The head unit 24 is mounted on a carriage (not shown) at an appropriate distance from the printing medium P during image printing, and may be moved together with the carriage as appropriate in accordance with an operation of a carriage drive 242 (mover) (described below). The head unit 24 is moved by an appropriate known means selected from, for example, moved along a rail driven by a circulated or wound belt, rotation of engaged gears in accordance with the rotation of a stepper motor, and a variation in hydraulic pressure. Different techniques may be used between a first move operation (described below) for varying the distance from the outer periphery of the image forming drum 21 and a second move operation (described below) for exposing the outer periphery.

Each second sensor 25 detects a contact between any nozzle surface in any head unit 24 and the printing medium P. The second sensor 25 has the same configuration as the first sensor 23. An uplift level detected by the second sensor 25 set to a certain value allows the second sensor 25 to detect a contact between a nozzle surface and the printing medium P or an equivalent state (for example, a possibility of a later or temporal contact due to vibrations during move of a head unit 24, despite no contact detected currently). The certain value is a maximum distance along which the head unit 24 moves outward along the rotation radius of the image forming drum 21 from the outer periphery (i.e., radially outward from the rotation axis perpendicular thereto) or a slightly shorter distance (for example, a distance less than the maximum distance by several percent or by a minimum distance detectable by the second sensor 25). The second sensor 25 is provided in each head unit 24.

The irradiator 26 radiates energy lines with a predetermined wavelength (ultraviolet rays in this embodiment) to cure the ink discharged from the head units 24 on the printing medium P. The irradiator 26 includes, for example, a fluorescent lamp, such as a low-pressure mercury lamp, emitting ultraviolet rays in response to an applied voltage. The irradiator 26 is disposed in the vicinity of the outer periphery of the image forming drum 21 such that ultraviolet rays can be radiated on the printing medium P before conveyance of the printing medium P from the image forming drum 21 to the delivery unit 27 after discharge of inks on the printing medium P conveyed in accordance with the rotation of the image forming drum 21 from the head units 24. The irradiator 26 radiates energy lines on the printing medium P with inks discharged on the outer periphery of the image forming drum 21 to cure the inks on the printing medium P by the action of the energy lines.

The fluorescent lamps that radiate ultraviolet rays are not limited to low-pressure mercury lamps. Examples of other fluorescent lamps include mercury lamps with an operating pressure of several hundred Pa to 1 MPa, light sources functioning as sterilizing lamps, cold-cathode ray tubes, UV sources, metal halide lamps, and light-emitting diodes. For inks curable by energy lines other than ultraviolet rays, a light source emitting energy lines with a wavelength that can cure such inks is disposed in place of the light source emitting ultraviolet rays.

The rotation gauge 28 includes, for example, an encoder and outputs a signal for measuring the rotation angle of the image forming drum 21 to the controller 40. The measurements of the rotation gauge 28 are used to detect any erroneous rotation of the image forming drum 21 or control the timing at which the printing medium P is conveyed from the reception unit 22 to the image forming drum 21 or at which inks are discharged from nozzles in the head units 24.

The delivery unit 27 conveys the printing medium P from the image forming drum 21 to the copy receiving tray 30 after attached inks are cured. The delivery unit 27 includes a cylindrical delivery roller 271, multiple (for example, two) rollers 272 and 273, and a circular belt 274 inside of which is supported by the rollers 272 and 273. The delivery roller 271 guides the printing medium P from the image forming drum 21 onto the belt 274. After conveyance of the printing medium P from the delivery roller 271 onto the belt 274, which circles around the rollers 272 and 273 in accordance with the rotation thereof, the delivery unit 27 moves the printing medium P on the belt 274 to the copy receiving tray 30.

The image former 20 is substantially accommodated in a housing 200 and has a front door 201 (opening and closing section). The door 201 has an interlock function which, normally, locks the door 201 while the image former 20 is active and shuts off the power to the inkjet printing apparatus 1 in case of emergent opening of the door 201. The opening of the door 201 can also be controlled by the controller 40: When the inkjet printing apparatus 1 is in an abnormal state, the door 201 can be opened under certain conditions while the power supply to the inkjet printing apparatus 1 is continued. In this case, the rotation of the image forming drum 21 should be preferably disabled or maybe allowed only at a significantly slower rate than that during image formation, depending on user's operation. This significantly reduces the risk of user's hand being trapped.

The copy receiving tray 30 stores the printing medium P conveyed from the image former 20 after the image formation until a user picks it up.

In the above configuration, the image forming drum 21, the reception unit 22 and the delivery unit 27 constitute a conveyer.

Figure 2:
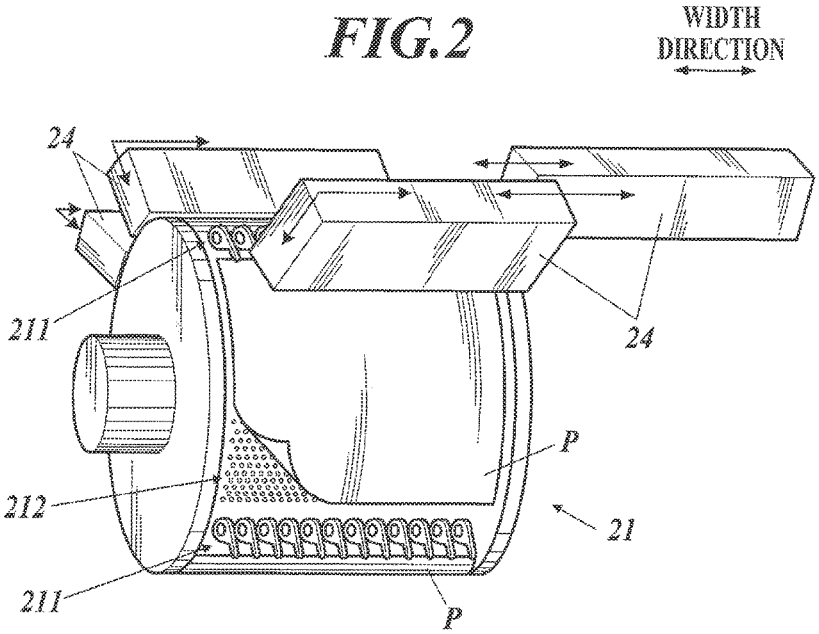
FIG. 2 is a perspective view illustrating the positions of head units relative to an image forming drum.

FIG. 2 is a perspective view of the head units 24 on the image forming drum 21.

The image forming drum 21 includes a claw section 211 and an air sucking section 212 for carrying the printing medium P on its outer periphery. The claw section 211 has multiple claws on the outer periphery of the image forming drum 21 at predetermined positions across the width to carry one end of the printing medium P between the claw section and the outer periphery of the image forming drum 21.

The air sucking section 212 includes air sucking holes on the outer periphery of the image forming drum 21 and a suction unit that suctions gas into the image forming drum 21 through the air sucking holes. The suction unit is an air pump or a fan. The air sucking section 212 uses suction power generated by suction through the air sucking holes to carry the printing medium P conforming with the outer periphery of the image forming drum 21.

Each head unit 24 can move in the radial direction outward from the outer periphery of the image forming drum 21 and then further move across the width perpendicular to the conveyance direction of the printing medium individually. In other words, the head unit 24 can move such that the nozzle surfaces retract from the positions where they face the image forming drum 21. The head unit 24 moves under the control of the controller 40 as follows: When an image is to be formed, nozzle surfaces move to the nearest positions facing the image forming drum 21 and suitable for ink discharge. When the uplift of the printing medium P is detected, the head unit 24 temporarily moves to expand the distance between the outer periphery of the image forming drum 21 and the nozzle surfaces, which is referred to as a first move operation. The first move operation is vertical relative to the outer periphery. When a lifting printing medium P is to be removed from the outer periphery or various maintenance operations, such as cleaning of the nozzle surfaces, are to be performed, the head unit 24 is moved to a position where the nozzle surfaces no longer face the outer periphery of the image forming drum 21, which is referred to as a second move operation. The second move operation results in exposure of the outer periphery of the image forming drum 21 and the printing medium P placed thereon. The exposure refers to provision of a space where no head unit 24 is disposed. More specifically, the space is (radially) above the outer periphery (conveying surface) and extends in a certain range. This space can be defined by the movement of the head unit 24 in a direction other than the (negative or positive) radial direction of the image forming drum 21. This provides a user with visibility of the outer periphery and an adequate space for inserting a hand to manually handle the printing medium P. The second move operation involves a move along the conveying surface across the width perpendicular to the conveyance direction of the printing medium P.

Figure 3:
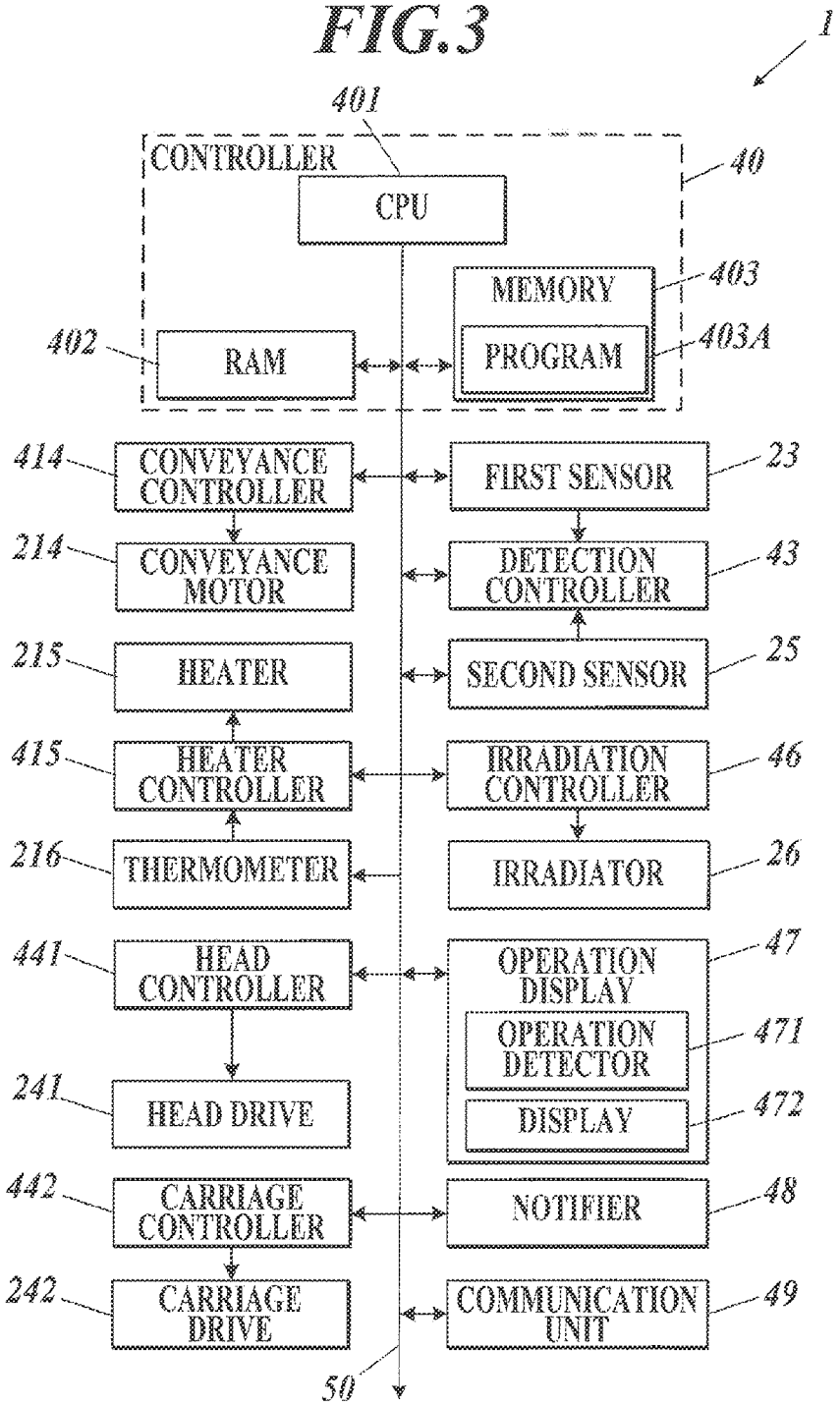
FIG. 3 is a block diagram illustrating a functional configuration of the inkjet printing apparatus.

The head unit 24 moves together with the carriage supporting the head unit 24 in accordance with an operation of a carriage drive 242 under the control of a carriage controller 442 (see FIG. 3). The inkjet printing apparatus 1 may perform cleaning of the nozzle surfaces at or near a position to which the head unit 24 is moved across the width as the second move operation. The second move operation may be performed for the purpose of retraction of the head unit 24 and cleaning.

The first move operation involves a travel in the order of millimeters to centimeters to address a slight uplift of the printing medium P, which normally occurs, while the second move operation requires a longer travel than the first move operation to provide a user with visibility and an adequate space for inserting a hand.

FIG. 3 is a block diagram showing a functional configuration of the inkjet printing apparatus 1 according to the embodiment.

The inkjet printing apparatus 1 further includes a conveyance motor 214, a head drive 241, a heater 215, a thermometer 216, a carriage drive 242, a conveyance controller 414, a heater controller 415, a head controller 441, a carriage controller 442, an irradiation controller 46, a detection controller 43, an operation display 47, a notifier 48, and a communication unit 49, which are connected via a bus 50.

The controller 40 comprehensively controls the inkjet printing apparatus 1 and includes a central processing unit (CPU) 401, a random access memory (RAM) device 402, and a memory device 403. The CPU 401 performs various calculations and control operations. The RAM device 402 provides a working memory space for the CPU 401 and stores temporary data. The memory device 403 contains control programs 403*a* and various setting information. The memory device 403 may temporarily store image data for printing jobs and processing data for the image data. The memory device 403 includes non-volatile memories, such as hard disk drives (HDDs) or flush memories, and high-rate volatile or non-volatile memories, such as DRAMs for temporarily storing image data.

The conveyance motor 214 includes a rotary motor for rotating the image forming drum 21. The conveyance motor 214 rotates the image forming drum 21 to convey a printing medium P at an appropriate speed in accordance with a control signal from the conveyance controller 414. The conveyance motor 214 cannot immediately stop the rotation of the image forming drum 21; the image forming drum 21 decelerates to a stop after the rotation for an angle corresponding to the rotational speed of the image forming drum 21.

The head drive 241 drives discharge of inks from nozzle openings in the head units 24. The head drive 241 applies a voltage with a waveform corresponding to an instruction of the head controller 441 to discharge or not discharge inks to deform an actuator that includes piezoelectric elements, and then shrinks or expands ink channels which are in communication with the nozzles in response to the deformation of the actuator to discharge inks.

The heater 215 heats the printing medium P directly or through the image forming drum 21. The head unit 24 may have another heater to heat inks to or keep them at an appropriate temperature, as described above. The thermometer 216 measures the temperature of the outer periphery of the image forming drum 21, which is heated by the heater 215 (predetermined heated portion). The thermometer 216 may further measure the temperature of heated inks or the ink channels to control the heating of the inks described above. The heater controller 415 turns on or off the heater 215 to keep the heated items in an appropriate range of temperature in accordance with observed data from the thermometer 216. Alternatively, the heater controller 415 may vary the energy applied to the heater 215.

The carriage drive 242 moves the carriage supporting the head unit 24, as described above, in response to a control signal of the carriage controller 442 to move the head unit 24. The carriage drive 242 performs the first move operation, which outwardly moves the carriage along the radius of the image forming drum 21 from its outer periphery, and the second move operation, which moves the carriage across the width of the image forming drum 21 so as to or not to face the outer periphery of the image forming drum 21.

The detection controller 43 controls the operations of the first sensor 23 and the second sensor 25 and outputs detection data to the CPU 401 of the controller 40. Upon detection of uplift of the printing medium P, i.e., during image printing and conveyance of the printing medium P, involved in the image printing, in accordance with rotation of the image forming drum 21, the detection controller 43 acquires data on the amount of light received from the first sensor 23. Upon detection of an error by the first sensor 23, the detection controller 43 activates the second sensor 25, as needed, to acquire data on the amount of light received from the second sensor 25. Upon acquisition of data on the amount of light received, the detection controller 43 may sample analog signals in accordance with the amount of light received, as appropriate, at an analog-digital-converter (ADC) to output digital signals or may compare a signal voltage with a reference voltage to acquire a binary voltage signal indicating whether the amount of light received is normal or not.

The irradiation controller 46 controls the irradiator 26 to cure inks discharged from the nozzles in the head units 24 onto the printing medium P. The irradiation controller 46 should radiate ultraviolet rays toward an ink-printed printing medium P while the printing medium P travels between the irradiator 26 and the image forming drum 21. Upon suspension of image printing, the irradiation controller 46 stops radiation of the ultraviolet rays.

The operation display 47 accepts user operations and displays information or menus for users. Examples of the operation display 47 include a liquid crystal display (LCD) functioning as a display 472 to display various menus and status for image formation on the LCD display. The operation display 47 includes a touch panel, functioning as an operation detector 471, for the LCD and allows touch operations suitable for display on the LCD to be detected by superimposing the touch panel on the LCD display.

Upon occurrence of an error in the inkjet printing apparatus 1, the notifier 48 performs a predetermined notification operation. Examples of the notifier 48 include a sound generator that generates predetermined beep tones with a piezoelectric element or a light emitter that turns on or off an LED lamp.

The communication unit 49 is an interface that connects to external devices, such as PCs, to perform data communications in accordance with standards. Examples of the communication unit 49 include a network card for connecting LANs, a radio communication interface using Bluetooth (Registered trade mark: Bluetooth), or connection terminals or drivers for direct connection to external devices via USBs. The controller 40 acquires a print instruction and image data for image formation relevant to the print instruction from external devices via the communication unit 49 and outputs status information to the external devices.

In this configuration, the control operations of the individual controllers, i.e., the conveyance controller 414, the head controller 441, the heater controller 415, the detection controller 43, and the irradiation controller 46, may be performed comprehensively by the CPU 401 of the controller 40 or may be performed individually by multiple CPUs and RAMs in response to control signals from the CPU 401 of the controller 40.

Operations to avoid a contact between a printing medium P and a head unit 24 in the inkjet printing apparatus 1 according to the embodiment will now be described.

FIGS. 4A to 4C, 5A, and 5B describe the retraction of the head unit 24 and the detection of the printing medium in the inkjet printing apparatus 1 according to the embodiment.

Figure 4A:
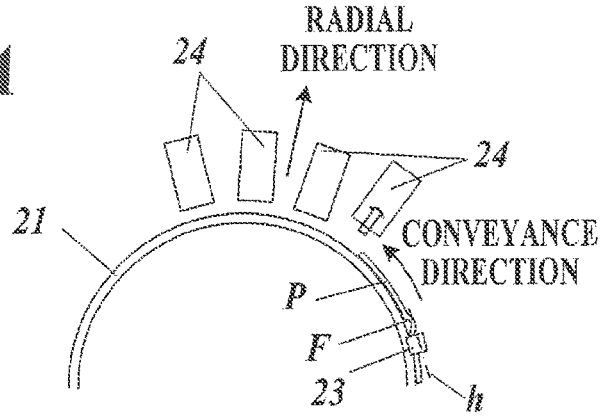
FIG. 4A illustrates retraction of a head unit.

FIG. 4A illustrates the image forming drum 21 viewed from the direction of its rotation axis. As shown in FIG. 4A, if the printing medium P has a lifting portion F on the image forming drum 21, the first sensor 23 detects the lifting portion F above the reference level h, stops the rotation of the image forming drum 21, and instructs the head unit 24 to move outward along the radius of the image forming drum 21, i.e., vertically upward relative to the outer periphery. The moving operation is performed separately for individual head units 24. Alternatively, the operation may be performed concurrently for all the head units 24.

Figure 4B:
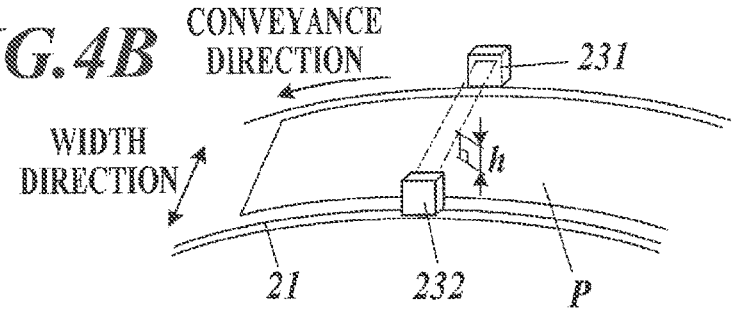
FIG. 4B illustrates detection of a printing medium.

FIG. 4B is a perspective view of the outer periphery of the image forming drum 21. As shown in FIG. 4B, the first sensor 23 include a light emitter 231 and a photodetector 232. The light emitter 231 radiates laser light toward the photodetector 232 across the width at a position higher than the reference level h from the outer periphery of the image forming drum 21. A lifting portion F between the light emitter 231 and the photodetector 232 would shield the laser light and reduce the amount of light detected by the photodetector 232.

Figure 4C:
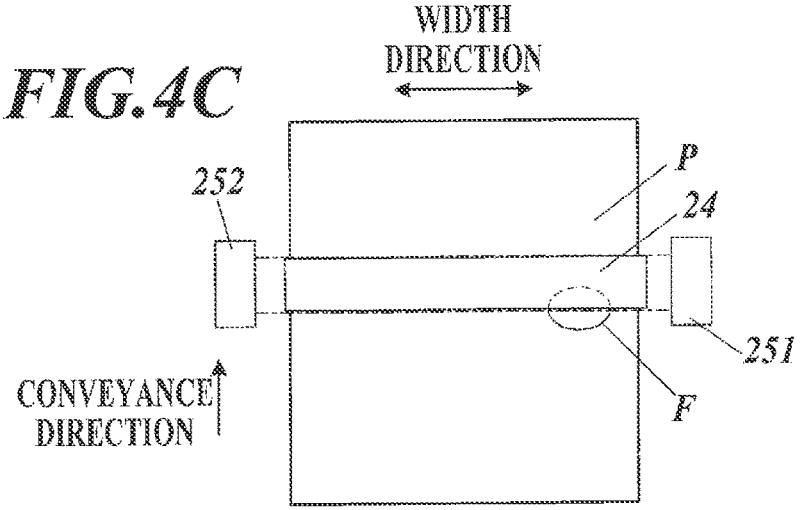
FIG. 4C illustrates detection of a printing medium.

Upon stop of rotation of the image forming drum 21, the second sensor 25 checks for contact of the lifting portion F with the head unit 24. As described above, since the rotation of the image forming drum 21 is not stopped immediately, the lifting portion F detected by the first sensor 23 may reach a position facing the head unit 24. FIG. 4C is a top view of the printing medium P and the second sensor 25 facing the conveying surface. As shown in FIG. 4C, the lifting portion F partially shields light emitted from a light emitter 251 of the second sensor 25. The photodetector 252 of the second sensor 25 receives the partially shielded light and detects the contact of the head unit 24 with the lifting portion F in accordance with the amount of light it has received. In this case, the head unit 24 is not moved.

Figure 5A:
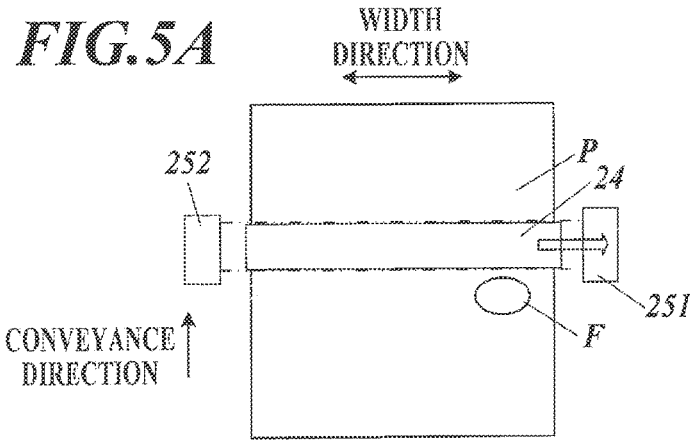
FIG. 5A illustrates detection of a printing medium.
Figure 5B:
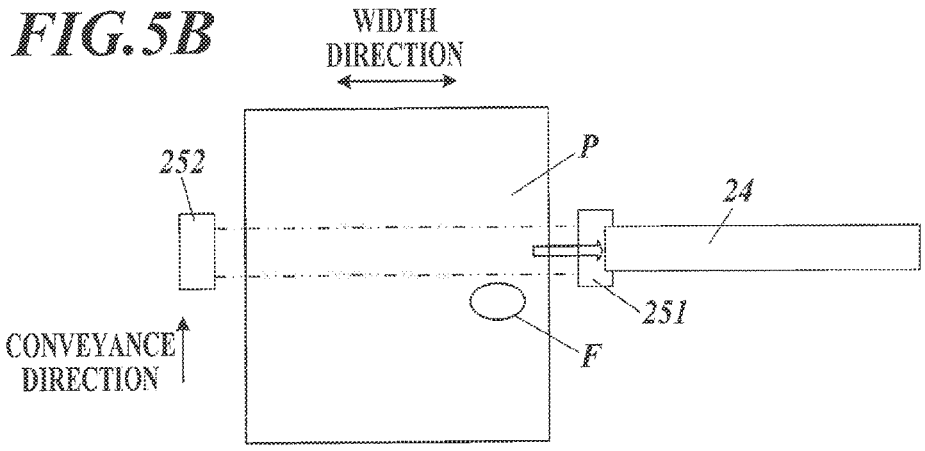
FIG. 5B illustrates retraction of a head unit.

Meanwhile, as shown in FIG. 5A where the lifting portion F is not in contact with the head unit 24, the photodetector 252 of the second sensor 25 receives entire light emitted from the light emitter 251 and detects no contact of the head unit 24 with the lifting portion F in accordance with the amount of received light. In this case, the head unit 24 is moved across the width to a retraction position, as shown in FIG. 5B. The head unit 24 and the photodetector 252 are disposed or moved such that they do not come into contact with each other during retraction of the head unit 24. FIG. 5B illustrates the head unit 24 which is completely retracted from the printing medium P. Alternatively, the head unit 24 may be retracted such that the printing medium P is partially exposed, depending on the situation.

Figure 6:
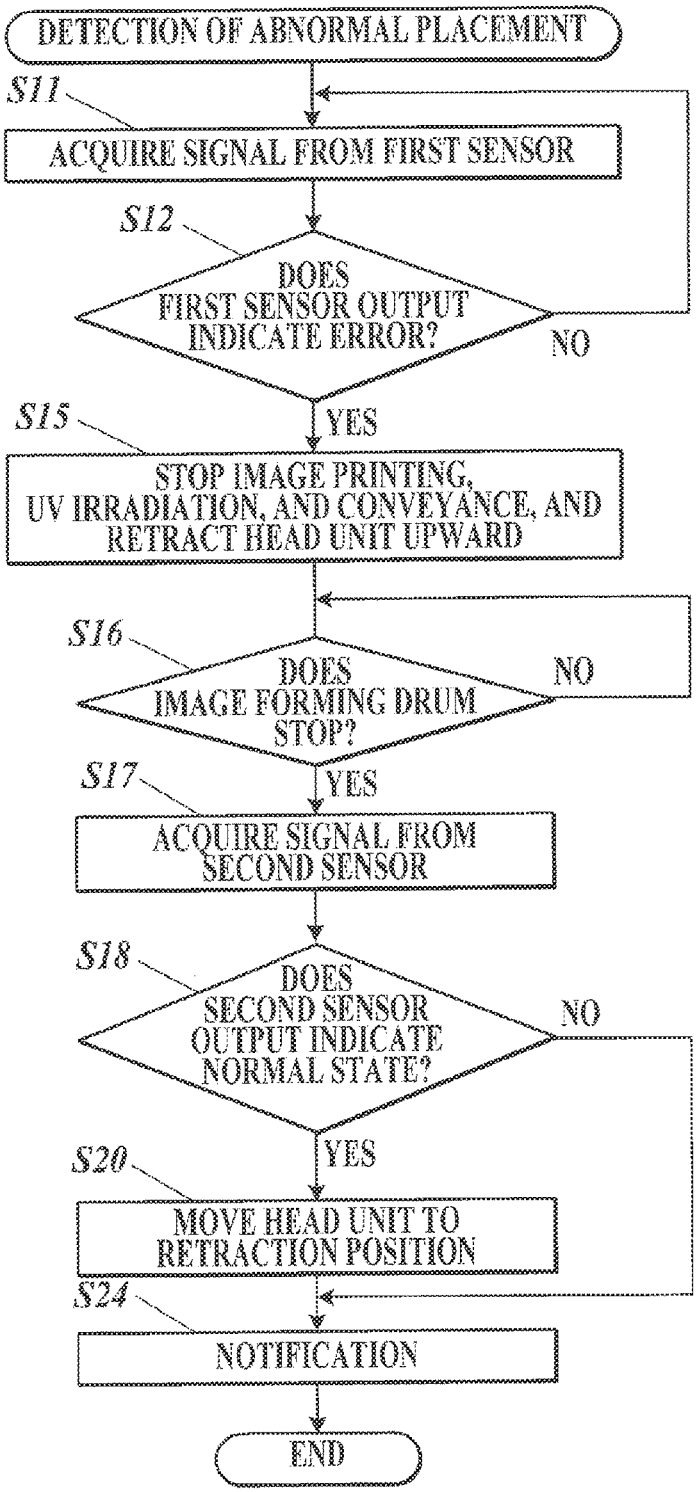
FIG. 6 is a flowchart indicating a procedure for controlling detection of abnormal placement.

FIG. 6 is a flowchart indicating a procedure for controlling detection of abnormal placement performed by the controller 40 in the inkjet printing apparatus 1 according to the embodiment.

The detection of abnormal placement begins with the start of rotation of the image forming drum 21 and conveyance of a printing medium and ends with stop of the rotation of the image forming drum 21 and the conveyance of the printing medium in the image printing.

Upon start of detection of abnormal placement, the controller 40 (CPU 401) acquires a signal indicating the amount of light received by the photodetector of the first sensor 23 (STEP S11). The controller 40 determines whether the amount of light detected is abnormal (STEP S12). If the amount is determined to be not abnormal ("NO" at STEP S12), the controller 40 returns to STEP S11.

If the amount is determined to be abnormal ("YES" at STEP S12), the controller 40 stops ink discharge, radiation of ultraviolet rays at the irradiator 26, and conveyance of the printing medium P and then moves the head unit 24 away from the printing medium P to a maximum separation distance (STEP S15). The controller 40 turns off the heater 215 to lower the temperature of the image forming drum 21. The controller 40 may continue to operate the air sucking section 212 after the stop of the conveyance of the printing medium P until the actual stop of the rotation of the image forming drum 21 because the suction of air can efficiently lower the temperature of the outer periphery of the image forming drum 21.

The controller 40 determines whether the rotation of the image forming drum 21 has stopped (STEP S16). If the rotation is determined not to have stopped ("No" at STEP S16), the controller 40 repeats STEP S16. If the rotation is determined to have stopped ("YES" at STEP S16), the controller 40 acquires a signal indicating the amount of light received by the photodetector 252 of the second sensor 25 (STEP S17).

The controller 40 determines whether the amount of light received by the second sensor 25 is in a normal range (STEP S18). If the amount of light is determined to be within the normal range ("YES" at STEP S18), the controller 40 instructs the head unit 24 to move across the width to a retraction position (STEP S20). The controller 40 instructs the notifier 48 and/or the display 472 to indicate that image printing has been stopped due to an abnormal placement (STEP S24). If the amount of light received by the second sensor 25 is determined to be out of the normal range ("NO" at STEP S18), the process of the controller 40 goes to STEP S24. At the end of STEP S24, the controller 40 terminates the detection of abnormal placement.

In the case of discontinuation of image formation on the printing medium P in the middle, the controller 40 should preferably instruct to resume output of image data that has been discontinued to the head unit 24 from the beginning so that data formation for the discontinued image data is resumed from the beginning upon resumption of image formation.

[Variation 1]

Figure 7A:
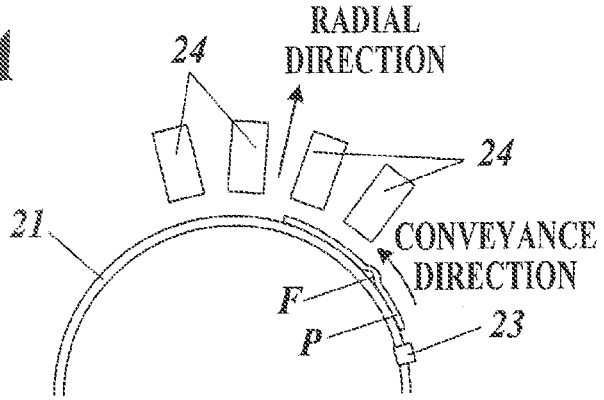
FIG. 7A illustrates an inkjet printing apparatus according to Variation 1.
Figure 7B:
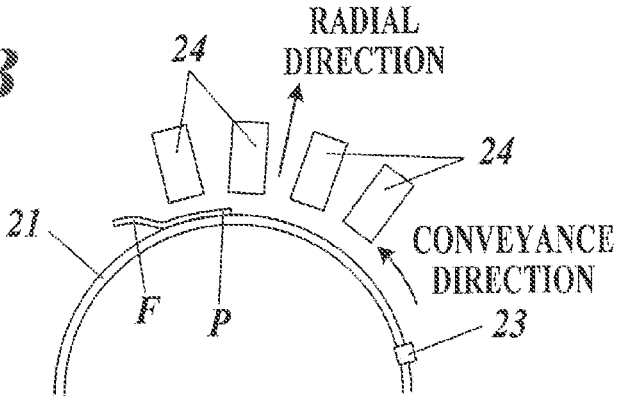
FIG. 7B illustrates the inkjet printing apparatus according to Variation 1.

FIGS. 7A and 7B illustrate retraction of head units 24 of an inkjet printing apparatus 1 according to Variation 1. The FIGS. 7A and 7B are viewed from the same direction as FIG. 4A.

In the above embodiment, if a head unit 24 is determined to be retractable to a retraction position in accordance with the amount of light received by the second sensor 25, a head unit 24 is always moved. In Variation 1, if a printing medium P can be discharged without the movement of the head unit 24 to a retraction position, a conveyer is redriven to discharge the printing medium P.

For example, if a lifting portion F is at a height where it does not come into contact with a head unit 24 which has been already retracted in the radial direction, as shown in FIG. 7A, the head unit 24 does not need to be moved to a retraction position. This operation can be achieved by detecting the uplift of the printing medium P at two levels by the first sensor 23 and determining whether a detected printing medium P has a lifting portion F to come into contact with the head unit 24 which has been already retracted in the radial direction.

As shown in FIG. 7B, if the lifting portion F has already passed through the head unit 24 after a contact therewith, the printing medium P may be continued to be discharged. This operation can be achieved by detecting the uplift of the printing medium P at two levels with a first sensor 23, as described above, and, for example, calculating how far the lifting portion F has already moved based on the measurements of the rotation gauge 28. A jam caused by the printing medium P trapped in the head unit 24 can be detected with the second sensor 25, but a jam occurring at any other position may not be detected. In this case, the inkjet printing apparatus 1 may always instruct a user to visually inspect the printing medium P, instead of automatic determination of discharge.

Figure 8:
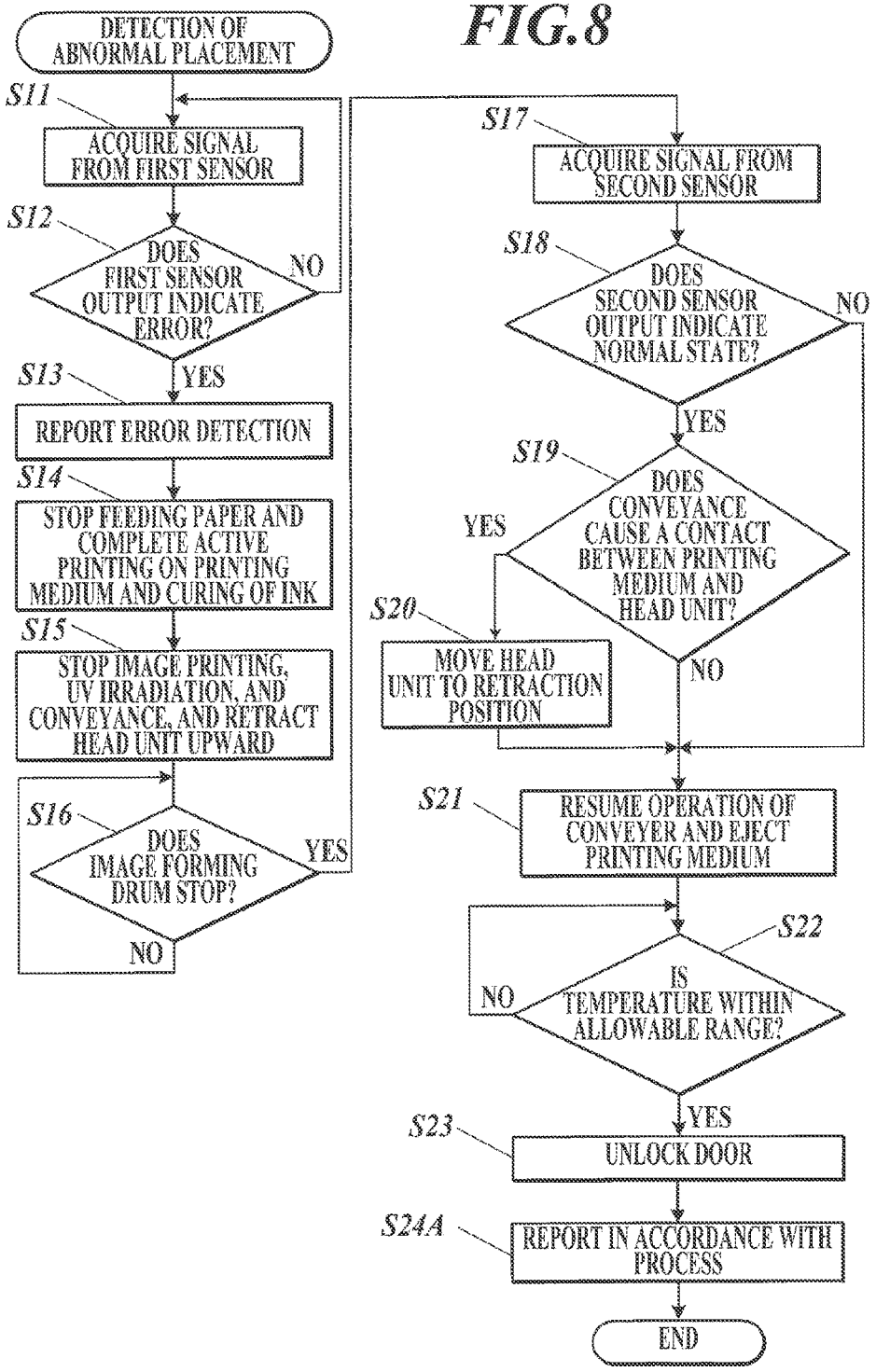
FIG. 8 is a flowchart indicating a procedure for controlling detection of abnormal placement according to Variation 1.

FIG. 8 is a flowchart indicating a procedure for controlling the detection of abnormal placement by the controller 40 in the inkjet printing apparatus 1 according to Variation 1.

The detection of abnormal placement according to Variation 1 further includes STEPS S13, S14, S19, and S21 to S23 in addition to the steps according to the above-described embodiment, and STEP S24*a* instead of STEP S24. Other steps are the same as those according to the embodiment and the same steps are given the same reference numerals and a detailed description is omitted.

If output from the first sensor 23 is determined to be abnormal in the determination process at STEP S12 ("YES" at STEP S12), the controller 40 (CPU 401) instructs the notifier 48 to notify the user of the error detection (STEP S13). The controller 40 allows an image under formation to be continuously printed on the printing medium until the rear end thereof is reached and then instructs the irradiator 26 to cure the image printed on the printing medium (STEP S14). The process of the controller 40 then goes to STEP S15.

If output from a second sensor 25 is determined to be not normal in the determination process at the STEP S18 ("NO" at STEP S18), the process of the controller 40 goes to STEP S22.

If output from the second sensor 25 is determined to be normal in the determination process at the STEP S18 ("YES" at STEP S18), the controller 40 checks for contact of the printing medium P with the head unit 24 before the controller 40 instructs the image forming drum 21 to further rotate (STEP S19). If no contact is determined ("NO" at STEP S19), the process of the controller 40 goes to STEP S21. If contact is determined ("YES" at STEP S19), the controller 40 instructs the head unit 24 to travel to a retraction position (STEP S20). The process of the controller 40 then goes to STEP S21.

At STEP S21, the controller 40 rerotate the image forming drum 21 to discharge the printing medium P (STEP S21). The process of the controller 40 then goes to STEP S22.

At STEP S22, the controller 40 determines whether the temperature of the image forming drum 21 is within a standard range (STEP S22). The standard range is determined to be the one that does not cause a problem even if a user touches the image forming drum 21 (for example, not less than 0° C. to not more than 40° C.). If the temperature is determined to be the outside of the standard range ("NO" at STEP S22), the controller 40 repeats STEP S22. If the temperature is determined to be within the standard range ("YES" at STEP S22), the controller 40 unlocks the door 201 so that it can be opened (STEP S23). The controller 40 instructs the notifier 48 to notify the user in accordance with the steps taken after STEP S18 (STEP S24*a*). The controller 40 then terminates the detection of abnormal placement.

After STEP S24*a*, the controller 40 need not terminate the detection of abnormal placement immediately; it may perform control operations of each unit, depending on user's operations, while the door 201 is opened. More specifically, the controller 40 may prohibit the execution of a submitted printing job, prohibit the operation of each unit, such as the irradiator 26, depending on user's operation for the operation detector 471, or limit the rotation rate of the image forming drum 21 (rotation at a lower rate than that during a normal image formation (conveyance operations)) or a maximum rotation angle per rotation.

[Variation 2]

Figure 9A:
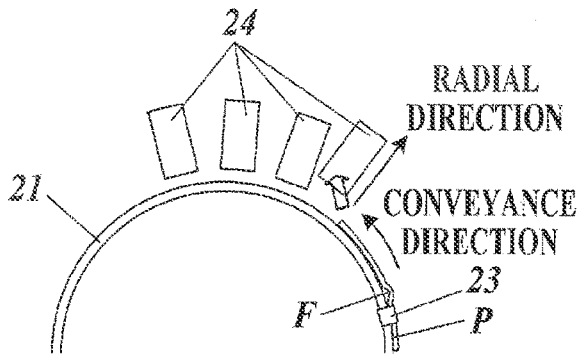
FIG. 9A illustrates an inkjet printing apparatus according to Variation 2.
Figure 9B:
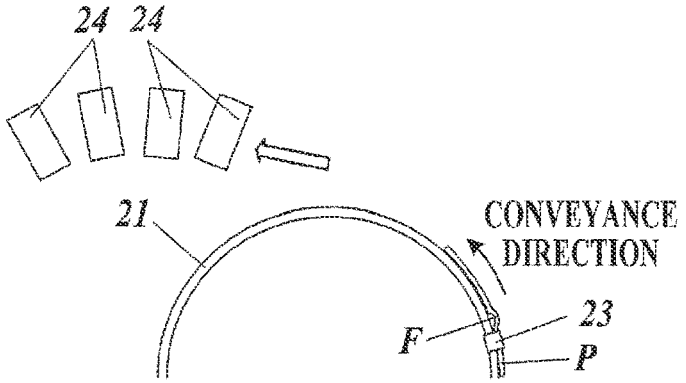
FIG. 9B illustrates the inkjet printing apparatus according to Variation 2.

FIGS. 9A and 9B illustrate an inkjet printing apparatus 1 according to Variation 2 and are viewed in the same direction as FIG. 4A.

The inkjet printing apparatus 1 moves away a head unit 24 diagonally from the printing medium P (the outer periphery of the image forming drum 21), not vertically relative to the outer periphery of an image forming drum 21, as shown in FIG. 9A. The head unit 24 may be moved away from the outer periphery in a preferred direction, depending on the structure or position of its carriage.

As shown in FIG. 9B, the head unit 24 may be moved to a direction having the vector of the conveyance direction to expose the printing medium P (the outer periphery of the image forming drum 21). In this case, moving the multiple head units 24 in the same direction relative to the outer periphery of the image forming drum 21 may result in a temporal reduction in the distance between the nozzle surfaces in some head units 24 and the outer periphery of the image forming drum 21. The moving direction should preferably be determined not to reduce such a distance.

[Variation 3]

Figure 9C:
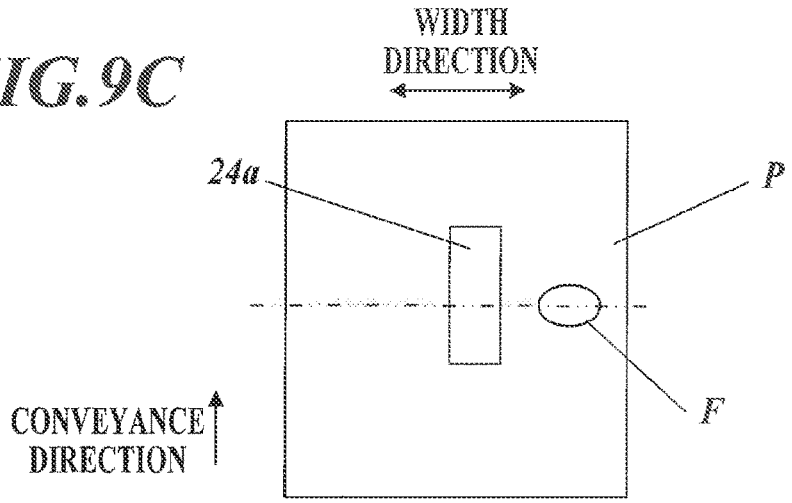
FIG. 9C illustrates an inkjet printing apparatus according to Variation 3.

FIG. 9C illustrates an inkjet printing apparatus 1 according to Variation 3 and is viewed in the same direction as FIG. 4C.

The inkjet printing apparatus 1 according to Variation 3 includes the head units 24 equipped with scan heads which discharge inks while moving (scanning) across the width, in place of the head units 24 equipped with line heads. Retracting a scan head across the width to expose the printing medium P may result in contact with a printing medium P during the retraction, even if the scan head is not in contact with the printing medium P when the conveyance stops. The inkjet printing apparatus 1 does not retract the head unit 24 in this case.

As described above, the inkjet printing apparatus 1 according to the embodiment includes a conveyer conveying the printing medium P (the image forming drum 21, the reception unit 22, and the delivery unit 27), the head units 24 discharging inks on a printing medium P to form an image, the carriage drive 243 moving the head units 24, the first sensor 23 detecting uplift of the printing medium P under the conveyance from the conveying surface of the image forming drum 21 as an abnormal conveyance state, the second sensors 25 each detecting a contact between the printing medium P and the corresponding head unit 24, and the controller 40 controlling image formation.

The carriage drive 243 performs the first move operation, which moves a head unit 24 so as to expand the distance between the head unit 24 and the conveying surface of the printing medium P, and the second move operation, which moves the head unit 24 so as to expose the conveying surface. Upon detection of uplift of the printing medium P by the first sensor 23, the controller 40 instructs the conveyer (the image forming drum 21) to suspend the conveyance operation and the carriage drive 243 to perform the first move operation. After the image forming drum 21 stops conveyance of the printing medium P and the first move operation is completed, the controller 40 checks for contact of the head unit 24 with the printing medium P between the start and end of the second move operation based on the results of the detection at the second sensor 25 before the second move operation is performed. If no contact is determined, the controller 40 instructs the carriage drive 243 to perform the second move operation; otherwise, the controller 40 does not instruct the carriage drive 243 to perform the second move operation.

In other words, the second move operation is performed after the first move operation only if the printing medium P does not come into contact with the head unit 24 nor is it caught in the head unit 24. This can effectively prevent damage of the nozzle surfaces in the head unit 24 during retraction of the head unit 24. Accordingly, the head unit 24 (i.e., printing head) can be properly retracted in accordance with the state of the printing medium P in an erroneous conveyance.

As described above, retraction performed in the form of two different moves can define a space required for retraction more efficiently than before and determine the travel direction and distance suitable for each of the purposes of the moves: To avoid the printing medium P and to expose the printing medium P.

The first sensor 23 detects the uplift of the printing medium P to a predetermined reference level or higher from the conveying surface of the printing medium P as an abnormal conveyance state.

This can readily detect the risk of a jam caused by the printing medium P coming into contact with a nozzle surface of a head unit 24 or being trapped by a head unit 24 or other component.

The carriage drive 243 moves a head unit 24 in the direction perpendicular to the conveying surface of the printing medium P during the first move operation. This allows the head unit 24 to be retracted from a lifting portion at a minimum distance, effectively reducing the risk of the contact of the lifting portion with a nozzle surface of the head unit 24.

The carriage drive 243 moves the head unit 24 in the direction perpendicular to the conveyance direction of the conveyer (image forming drum 21), which conveys the printing medium P along the conveying surface of the printing medium P. This can expose a space above the conveying surface widely, allowing the user to insert a hand, visually check the printing medium P for an erroneous conveyance easily, and adjust the lifting portion. In the case of the inkjet printing apparatus 1 equipped with a drum-shaped conveyer and the multiple head units 24, mere radial movement of the head units 24 from the conveying surface takes a large volume of space since retraction positions are spread. A parallel movement of the head units 24 across the width during the second move operation can save the space.

Each head unit 24 is equipped with a line head having nozzles disposed at different positions across the width so that inks can be discharged on the printing medium P across the printable width, in the width direction perpendicular to the conveyance direction of the printing medium P by the image forming drum 21. Since the line head entirely covers the printing medium P in the width direction, just moving away the head unit radially is likely to require a large space for the user to visually check and adjust the abnormal conveyance state of the printing medium P. Meanwhile, the movement of the head unit 24 in the width direction during the second move operation facilitates retraction of the line head and exposes the printing medium P so that the user can visually inspect and adjust the printing medium P. In particular, a larger or heavier head unit 24 or carriage is likely to require a large mechanism to lift them up above the image forming drum 21 in defiance of gravity. Accordingly, the horizontal second move operation, which has a longer travel distance than the first move operation, can simplify the carriage or other structures relevant to the travel.

An array of nozzle openings in the line head may be one or two dimensional. The direction of the one-dimensional array or the direction of one axis of the two-dimensional array need not be parallel with the width direction.

The head units 24 are provided for a plurality of kinds of ink. The carriage drive 243 moves the head units 24 so as not to overlap with each other. The controller 40 checks for contact of each head unit 24 with the printing medium P from the start to end of the second move operation based on the results of the detection at the second sensor 25 and instructs the carriage drive 243 to perform the second move operation of the head unit(s) 24 if the controller 40 determines that the head unit(s) 24 is not in contact with the printing medium P.

Movement of only the head unit(s) 24 that can be moved safely to expose the conveying surface and the printing medium P in the vicinity of the head unit(s) 24 that cannot be moved facilitates manual handling of the user.

After the image forming drum 21 stops the conveyance, the controller 40 determines whether resumption of conveyance does not cause a contact between the head unit 24 subject to the first move operation and the printing medium P. If no contact is determined, the controller 40 instructs the conveyer (image forming drum 21) to resume conveyance and discharge the printing medium P. As described above, the inkjet printing apparatus 1 can discharge the printing medium P in an erroneous conveyance after determining that the printing medium P is not in contact with a nozzle surface after the first move operation, thus allowing image formation to be resumed while safely reducing the work required by the user upon occurrence of an abnormal conveyance state.

The controller 40 instructs the conveyer (image forming drum 21) to resume conveyance and discharge the printing medium P after the carriage drive 243 performs the second move operation. This allows a user to remove the printing medium P in an erroneous conveyance efficiently without causing scratch or dirt on the nozzle surfaces of the head units 24 or a jam and to resume image formation easily.

If the first sensor 23 detects an abnormal conveyance state, the controller 40 prohibits the conveyer (reception unit 22) from receiving a further printing medium P from the sheet feeder 10 keeping printing media P with no printed image. This can effectively prevent aggravation of a problem, such as a jam at the image former 20, facilitate handling, and prevent a wasteful use of extra printing media P.

If the first sensor 23 detects an abnormal conveyance state, the controller 40 instructs the image forming drum 21 to stop conveyance of a printing medium P and the head units 24 to stop image formation on the printing medium P. In other words, a prompt stop of image formation on the printing medium P for which image formation at a desired image quality is not expected due to the abnormal conveyance state can prevent a wasteful use of ink.

If the first sensor 23 detects an abnormal conveyance state, the controller 40 allows the head units 24 and the image forming drum 21 to operate continuously until completion of image formation on a printing medium P conveyed ahead of the printing medium P in an erroneous conveyance and then instructs the head units 24 to stop image formation and the image forming drum 21 to stop conveyance of printing media P. This allows the preceding printing medium P to be discharged successfully after a usual image formation, thus preventing a waste of the preceding printing medium P itself and the ink used for image formation before the detection of the abnormal conveyance state.

The inkjet printing apparatus 1 includes the irradiator 26 curing ink attached to a printing medium P. If the first sensor 23 detects an abnormal conveyance state, the controller 40 instructs the irradiator 26 to stop the operation after all the inks attached to an image formed by the head units 24 are cured. In other words, the irradiator 26 confirms the completion of curing of the ink used for image formation and then stops the operation. This can ensure the reliable formation of an image, reduce power consumption at the irradiator, and promptly lower the temperature of the irradiator 26, which generates much heat, so that the user can manually handle the printing medium as quickly as possible after the stop of conveyance and image formation, if such manual handling is required.

The inkjet printing apparatus 1 includes the housing 200 containing the head units 24 and at least portions of the conveyer (image forming drum 21) at which the head units 24 face the printing medium P to isolate them from the exterior. The housing 200 is equipped with the door 201. The controller 40 unlocks the door 201 after stop of operations of the head units 24 and the conveyance of the printing media P by the image forming drum 21. This allows a user to manually handle a printing medium P in an erroneous conveyance safely.

If the door 201 is opened after the image forming drum 21 stops the conveyance of a printing medium P in response to the detection of an abnormal conveyance state, the controller 40 allows the image forming drum 21 to convey a printing medium only at a lower rate than that during the image formation. The user can manually release a contact of the printing medium P with the head unit 24 and discharge the printing medium P to the copy receiving tray 30, at reduced risk involved in the manual operation.

The inkjet printing apparatus 1 includes the thermometer 216. If the thermometer 216 determines the temperature of the image forming drum 21, in particular, the heated section of its outer periphery heated by the heater 215 to be within a standard range, the controller 40 enables the door 201 to open. This can reduce the risk of touching the high-temperature section during manual removal or adjustment of the printing medium P.

The inkjet printing apparatus 1 includes the notifier 48 performing a predetermined notification operation. If the first sensor 23 detects an abnormal conveyance state, the controller 40 instructs the notifier 48 to perform a notification operation. This informs the user of at least suspension of image printing on the printing medium P due to an abnormal conveyance state.

The controller 40 instructs the notifier 48 to notify the user of the state of the second move operation. This informs the user the necessity for manual handling of the printing medium P, allowing the user to handle it properly.

It should be understood that the embodiments described above are not construed to limit the present invention and can be appropriately modified without departing from the scope of the present invention.

In the above embodiment, for example, a printing medium P is placed and conveyed on the outer periphery of the cylindrical image forming drum 21. The conveyer may not be a drum. Alternatively, the conveyer may be an endless belt on which the printing medium P may be placed and conveyed.

In the above embodiment, the head units 24 corresponding to four ink colors (CMYK) may be independently retractable. Alternatively, they are collectively retractable.

The abnormal conveyance state of a printing medium P should not be limited to a portion lifting to a reference level or higher. Alternatively, any abnormal conveyance states involving a normal conveyance may be included, for example, an improper orientation of a printing medium, an improper carriage of a printing medium between the claw section 211 and the outer periphery of the image forming drum 21, and any risk of a printing medium lifting later due to being trapped by the carriage of the inkjet printing apparatus 1 during conveyance.

As show in the above embodiment, the first sensor 23 is usually disposed between a position at which a printing medium P is conveyed from the reception unit 22 to the image forming drum 21 and a position at which the printing medium P faces the head unit 24. Alternatively, the first sensor 23 may be disposed between the head units 24 if multiple head units 24 corresponding to multiple ink colors are provided. Multiple first sensors 23 may be provided in a number corresponding to the number of the head units 24, just like the second sensors 25.

At least one of the first sensor 23 or the second sensors 25 may be of any type other than the laser sensor. For example, the non-laser sensor may detect an actual contact of a printing medium P through observed variations in pressure or electric conductivity caused by the contact. In this case, the contact should not worsen the conveyance state. If a laser light is used, a reflective sensor detecting reflective light from the printing medium P may be used.

In the above embodiment, a UV curable inks are used. Alternatively, other known inks may be used, in which case the irradiator 26 may be provided, as needed.

In above embodiment, the image forming drum 21, the head unit 24, and the irradiator 26 are stored in the housing 200 to isolate them from users via the door 201 for safety. Alternatively, other configurations may be used. A shutter or movable roof may be used in place of the door 201.

The notification operations need not be performed by the notifier 48 on the spot. Alternatively, alert information may be sent to an external device through the communication unit 49.

In the above embodiment, the second sensors 25 are used to detect a contact between a nozzle surface and the printing medium P. Alternatively, a contact between other portion of a head unit 24 and the printing medium P may be detected.

The orientation of the rotation axis of the image forming drum 21 and its relational positions with the head units 24 may be determined arbitrarily. The directions of the first move operation and the second move operation may be determined as appropriate, depending on their positions. The travel paths (directions) need not be a straight line and may be a curve or broken line.

In the above embodiment, the head units 24 move relative to the image forming drum 21. Alternatively, the head units 24 may move together with the image forming drum 21. For example, the first move operation may be retraction of a head unit 24 and the second move operation may be a pull out of the image forming drum 21.

In the above embodiment, the inkjet printing apparatus discharges inks by deformation of piezoelectric elements. Alternatively, the inkjet printing apparatus may be a thermal inkjet printing apparatus.

The configuration of the inkjet printing apparatus 1, the details or procedures of the control, and details of the above embodiment can be appropriately modified without departing from the scope of the present invention.

Although embodiments of the present invention have been described and illustrated in detail, it is clearly understood that the same is by way of illustration and example only and is not to be taken by way of limitation, and the scope of the present invention should be interpreted by terms of the appended claims.

INDUSTRIAL APPLICABILITY

The present invention is applicable to inkjet printing apparatus and methods for controlling them.

DESCRIPTION OF REFERENCE NUMERALS

1 inkjet printing apparatus
10 sheet feeder
11 sheet feeding tray
12 feeding board
121, 122 roller
123 belt
20 image former
200 housing
201 door
21 image forming drum
211 claw section
212 air sucking section
214 conveyance motor
215 heater
216 thermometer
22 reception unit
221 swing arm
222 reception drum
23 first sensor
231 light emitter
232 photodetector
24 head unit
241 head drive
242 carriage drive
25 second sensor
251 light emitter
252 photodetector
26 irradiator
27 delivery unit
271 delivery roller
272, 273 roller
274 belt
28 rotation gauge
30 copy receiving tray
40 controller
401 CPU
402 RAM device
403 memory device
403*a* program
43 detection controller
46 irradiation controller
47 operation display
48 notifier

49 communication unit
50 bus
414 conveyance controller
415 heater controller
441 head controller
442 carriage controller
471 operation detector
472 display
F lifting portion
P printing medium

The invention claimed is:

1. An inkjet printing apparatus comprising:

a conveyer conveying a printing medium;

at least one image former discharging ink to form an image on the printing medium;

a mover relatively moving the image former and the conveyer;

a first detector detecting an erroneous conveyance of a printing medium;

a second detector detecting a contact between the printing medium and the image former; and a controller controlling image formation, wherein the mover performs a first move operation relatively moving the image former and the printing medium to expand a distance between the image former and a conveying surface of the printing medium and performs a second move operation relatively moving the image former and the printing medium to expose the conveying surface, upon detection of an abnormal conveyance state of the printing medium by the first detector, the controller instructs the conveyer to stop conveyance and the mover to perform the first move operation, after the conveyer stops conveyance of the printing medium and the first move operation is completed, the controller checks for contact of the image former with the printing medium from start to end of the second move operation based on results of the detection at the second detector before the second move operation is performed, and if no contact is determined, the controller instructs the mover to perform the second move operation; otherwise, the controller does not instruct the mover to perform the second move operation.

2. The inkjet printing apparatus according to claim 1, wherein the first detector detects uplift of the printing medium to a predetermined reference level or higher from the conveying surface of the printing medium as the abnormal conveyance state.

3. The inkjet printing apparatus according to claim 1, wherein the mover moves the image former in the direction perpendicular to the conveying surface of the printing medium during the first move operation.

4. The inkjet printing apparatus according to claim 1, wherein the mover moves the image former in width direction perpendicular to a conveyance direction of the printing medium by the conveyer along the conveying surface of the printing medium during the second move operation.

5. The inkjet printing apparatus according to claim 1, wherein the image former includes a line head having nozzles disposed at different positions across width direction perpendicular to the conveyance direction of the printing medium by the conveyer so that ink can be discharged on the printing medium across printable width.

6. The inkjet printing apparatus according to claim 1, wherein the at least one image former comprises a plurality of image formers for a plurality of kinds of ink, the mover moves the image formers so as not to overlap with each other, and the controller checks for the contact of each of the image formers with the printing medium from start to end of the second move operation based on the results of the detection at the second detector and instructs the mover to perform the second move operation of an image former if the controller determines that the image former is not in contact with the printing medium.

7. The inkjet printing apparatus according to claim 1, wherein, after the conveyer stops the conveyance, the controller determines whether resumption of conveyance does not cause a contact between any one of the image formers subject to the first move operation and the printing medium, and if no contact is determined, the controller instructs the conveyer to resume conveyance and discharge the printing medium.

8. The inkjet printing apparatus according to claim 1, wherein the controller instructs the conveyer to resume conveyance and discharge the printing medium after the mover performs the second move operation.

9. The inkjet printing apparatus according to claim 1, wherein if the first detector detects the abnormal conveyance state, the controller prohibits the conveyer from receiving a further printing medium from a sheet feeder keeping printing media with no printed image.

10. The inkjet printing apparatus according to claim 1, wherein if the first detector detects the abnormal conveyance state, the controller instructs the conveyer to stop the conveyance and the image former to stop the image formation on a printing medium.

11. The inkjet printing apparatus according to claim 10, wherein if the first detector detects the abnormal conveyance state, the controller allows the image formers and the conveyer to operate continuously until completion of the image formation on a printing medium conveyed ahead of a printing medium in an erroneous conveyance and then instructs the image formers to stop the image formation and the conveyer to stop the conveyance.

12. The inkjet printing apparatus according to claim 1, further comprising a fixer fixing ink attached to the printing medium, wherein if the first detector detects the abnormal conveyance state, the controller instructs the fixer to stop operations after all images formed by the image formers are fixed.

13. The inkjet printing apparatus according to claim 1, further comprising a housing accommodating the image formers and at least a portion of the conveyer so that the image formers and the portion of the conveyer are isolated from the exterior, wherein a printing medium faces the image formers at the portion, wherein the housing includes a door and the controller unlocks the door after stop of operations of the image formers and conveyance of the printing medium by the conveyer.

14. The inkjet printing apparatus according to claim 13, wherein if the door is opened after the conveyer stops the conveyance of the printing medium in response to the detection of the abnormal conveyance state, the controller allows the conveyer to convey a printing medium only at a lower rate than that during the image formation.

15. The inkjet printing apparatus according to claim 13, further comprising a thermometer, wherein if the thermometer determines temperature of a predetermined heated section to be within a standard range, the controller enables the door to be opened.

16. The inkjet printing apparatus according to claim 1, further comprising a notifier performing a predetermined notification operation, wherein, if the first detector detects the abnormal conveyance state, the controller instructs the notifier to perform the predetermined notification operation.

17. The inkjet printing apparatus according to claim 16, wherein the controller instructs the notifier to perform different notification operations, depending on the state of the second move operation.

18. A method for controlling an inkjet printing apparatus, including a conveyer conveying a printing medium; an image former discharging ink to form an image on the printing medium; a mover moving the image former; a first detector detecting a printing medium in an erroneous conveyance; and a second detector detecting a contact between the printing medium and the image former, the method comprising:

detecting an abnormal conveyance state of the printing medium by the first detector followed by stopping conveyance by the conveyer and by performing a first move operation to expand the distance between the image former and a conveying surface of the printing medium, determining whether the image former is not in contact with the printing medium from start to end of a second move operation based on results of detection at the second detector, after the conveyer stops conveyance of the printing medium and the first move operation is completed and before the second move operation is performed to expose the conveying surface, and conveyance controlling to allow the mover to perform the second move operation if no contact is determined; or not to allow the mover to perform the second move operation if any contact is determined.

* * * * *